United States Patent [19]

Desmond

[11] Patent Number: 4,954,210

[45] Date of Patent: Sep. 4, 1990

[54] DISPENSER FOR ROLLED PRESSURE SENSITIVE LABELS

[76] Inventor: John W. Desmond, 104 Walter Dr., Media, Pa. 19063

[21] Appl. No.: 432,059

[22] Filed: Nov. 6, 1989

Related U.S. Application Data

[63] Continuation-in-part of Ser. No. 334,078, Apr. 6, 1989, abandoned.

[51] Int. Cl.[5] ..... B65C 11/00

[52] U.S. Cl. ..... 156/584; 221/71; 221/73

[58] Field of Search ..... 156/584, 577; 221/70, 221/71, 73

[56] References Cited

U.S. PATENT DOCUMENTS

| | | | |
|---|---|---|---|
| 2,276,297 | 3/1942 | Flood | 242/67.3 R |
| 2,341,368 | 2/1944 | Flood | 221/70 |
| 2,394,991 | 2/1946 | Flood | 221/70 |
| 2,838,171 | 6/1958 | Kaspar | 221/70 |
| 2,912,140 | 11/1959 | Cole | 221/70 |
| 3,066,881 | 12/1962 | Krueger | 242/55.53 |
| 3,077,919 | 2/1963 | Krueger | 156/584 |
| 3,128,012 | 4/1964 | Berg | 221/70 |
| 3,231,130 | 1/1966 | Foote | 221/70 |
| 3,308,002 | 3/1967 | Hurwich et al. | 156/577 |
| 4,097,328 | 6/1978 | Urushizaki | 156/577 |
| 4,570,868 | 2/1986 | Wiggs et al. | 221/73 |
| 4,576,311 | 3/1986 | Horton et al. | 156/584 |

*Primary Examiner*—Michael Wityshyn

*Attorney, Agent, or Firm*—Woodcock, Washburn, Kurtz, Mackiewicz & Norris

[57] ABSTRACT

A dispenser for dispensing labels from a backing strip upon which the labels are mounted with a pressure-sensitive adhesive backing on the labels, the labels being adapted to be peeled away from the backing strip by sharply reversely bending the backing strip over an edge. The used backing strip is automatically collected and stored within the housing as the strip is unwound from the supply roll and the pressure-sensitive adhesive backing labels dispensed from the dispenser. The dispenser includes only one moving part namely a combined take up roll and hand wheel both of which are confined within the housing of the dispenser.

17 Claims, 3 Drawing Sheets

DISPENSER FOR ROLLED PRESSURE SENSITIVE LABELS

This application is a continuation-in-part of my parent application Ser. No. 334,078 filed Apr. 6, 1989 entitled "Dispenser for Rolled Pressure Sensitive Labels".

INVENTION BACKGROUND OF THE

This invention relates to label dispensers and particularly a dispenser for dispensing labels from a backing strip upon which the labels are mounted with a pressure-sensitive adhesive backing on the labels, the labels being adapted to be peeled away from the backing strip by sharply reversely bending the backing strip over an edge. The use of address labels having a pressure-sensitive adhesive backing on the labels has become increasingly popular. The labels are sold in rolls with the labels being carried by a backing strip. One of the more popular types of housings or dispensers for such rolls of address labels has been the use of cardboard housings which are folded flat so they can be sent through the mail and thereafter assembled into a housing by the user. Examples of such type dispensers are disclosed in U.S. Pat. No. 2,341,368—Flood and 2,838,171—Kaspar. The cardboard dispensers leave something to be desired particularly in regard to ease of assembly by the user and also durability once assembled. Label dispensers with plastic housings have also been utilized such for example as disclosed in U.S. Pat. No. 2,912,140—Cole. All of these dispensers have the disadvantage that after the used backing strip has been discharged from the dispenser the backing strip dangles freely outside of the housing and thus must be torn off or otherwise disposed of. The U.S. Pat. No. 2,276,297—Flood discloses a label dispenser having an internal take-up roll for having the used backing strip wound thereon. However, the wheel for operating the take-up roll is disposed externally of the housing and does not provide a label dispenser which is easily packaged for mailing to customers. Furthermore, the label dispenser disclosed in this patent is of relatively complicated construction and thus increases the cost of manufacture.

It is an object of the present invention to provide a label dispenser of simple but study construction with only one moving part and that moving part being confined within the housing of the dispenser. By reason of this construction the dispenser can be easily packed for shipment to the customer and minimize any damage to the dispenser during shipment.

By reason of my improved design for the label dispenser the used backing strip is automatically collected and stored within the housing as the strip is unwound from the supply roll and the pressure-sensitive adhesive backing labels dispensed from the dispenser.

SUMMARY OF THE INVENTION

The present invention provides an improved dispenser for dispensing labels from a backing strip upon which the labels are mounted with a pressure-sensitive adhesive backing on the labels, the labels being adapted to be peeled away from the backing strip by sharply reversely bending the backing strip over an edge. The improvement comprises a housing for containing a supply roll of such a label strip, the housing having side walls, a top, a bottom and end walls, the housing being provided with an edge adjacent the junction of one of the end walls in the top thereof, together with an opening adjacent the junction, the strip being adapted to be withdrawn from the housing through the opening toward and over the edge to dispense a label. A second opening is provided in the housing adjacent to and spaced from the first-named opening to permit the backing strip to reenter the housing after dispensing a label. A pair of bearing members is carried by the opposite side walls within the housing and spaced from the periphery of the roll of the label strip and a shaft is carried by the bearing members within the housing, the shaft being adapted to have the backing strip wound thereon after the pressure-sensitive adhesive coated labels are peeled therefrom. A hand wheel is fixed to one end of the shaft for rotating the shaft, and the hand wheel being positioned within the housing between the pair of side walls and partially extending through an opening in the housing for manual rotation to dispense labels from the backing strip and for storing the backing strip on the shaft within the housing as the strip is unwound from the roll.

For more detailed disclosure of the invention and for further objects and advantages thereof, reference is to be had to the following description taken in conjunction with the accompanying drawings.

DESCRIPTION OF THE PREFERRED EMBODIMENT

Figure 1:
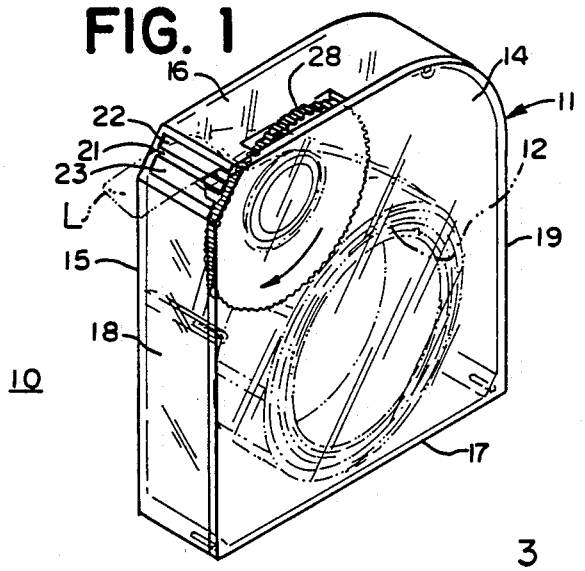
FIG. 1 is a perspective view of a preferred embodiment of my invention with the label dispenser illustrated in operating position.
Figure 2:
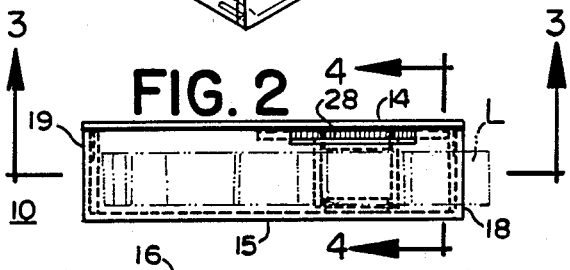
FIG. 2 is a top plan view of FIG. 1.
Figure 3:
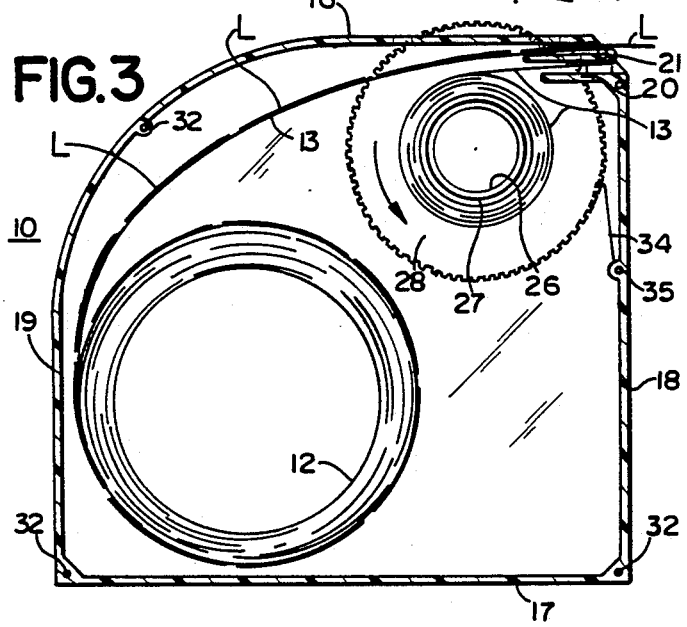
FIG. 3 is a sectional view taken along the lines 3—3 in FIG. 2.
Figure 4:
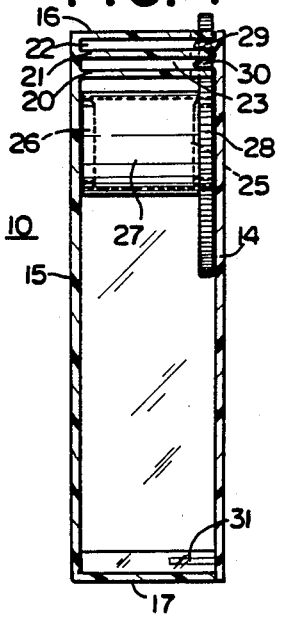
FIG. 4 is a sectional view taken along the lines 4—4 in FIG. 2.
Figure 5:
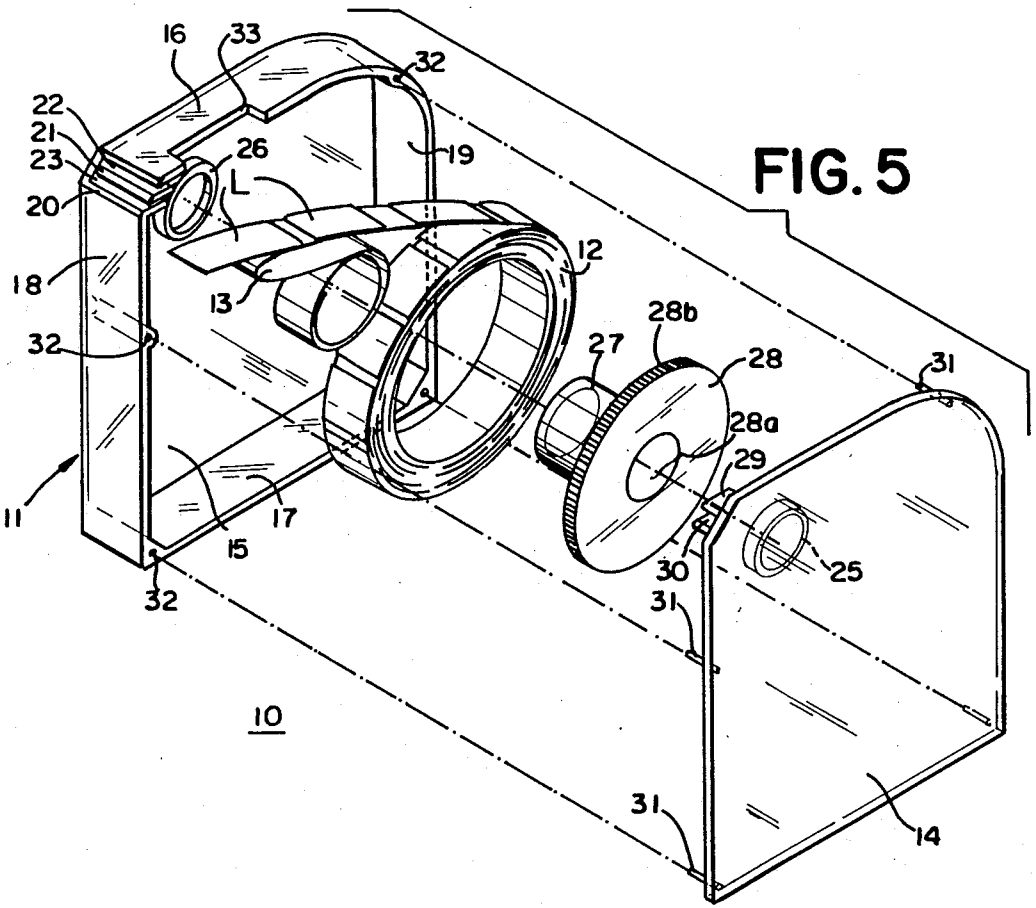
FIG. 5 is an exploded perspective view of the label dispenser illustrated in FIG. 1.

Referring to FIGS. 1-5 there is shown an improved label dispenser particularly suited for dispensing return address labels or the like of the pressure-sensitive adhesive type. Labels of this type are preliminarily attached to a backing strip from which they are later removed to be used. As may be seen in FIG. 1 the dispenser 10 comprises a housing 11 for containing a supply roll 12 of such a label strip. The supply roll of 12 includes a roll of backing strip 13, FIG. 3, on which are mounted a series of labels L with a pressure-sensitive adhesive backing on the labels. As may be seen in FIG. 3 the labels L are separated from each other along the backing strip 13. Referring to FIG. 1, the housing 11 comprises a pair of side walls 14 and 15, a top 16, a bottom 17, and a pair of end walls 18 and 19. As best shown in FIG. 5, the side wall 15, the top 16, the bottom 17 and the pair of end walls 18 and 19 preferably are molded from plastic as an integral housing unit. Also molded integral with this unit is a dispensing maze for the strip 13 comprising a pair of parallel members or fingers 20 and 21 which are spaced apart vertically and project horizontally from the side wall 15. The member 21 and the top 16 cooperate to provide a discharge opening 22 therebetween and the members 20 and 21 cooperate to provide a re-entry opening 23 therebetween. The outer end of the member 21 provides an edge over which the backing strip and labels are adapted to pass as later to be described. It will be noted that the edge of member 21 is located adjacent the junction of one of the end walls 18 and the top 16 of the housing. It will be also noted that the discharge opening 22 is also adjacent the junction of the end wall 18 and the top 16.

In dispensing the labels L from the roll 12 in the housing 11, the strip 13 is adapted to be withdrawn from the housing through the discharge opening 22 toward and over the edge 21 to dispense a label L as illustrated in FIGS. 1 and 3. The second or re-entry opening 23 in the housing 11 is adjacent to and spaced from the discharge opening 22 to permit the backing strip 13 to re-enter the housing 11 after dispensing a label. Thus it will be seen that the members or fingers 20 and 21 function as a dispensing maze for the label carrying strip 13.

As may be seen in FIGS. 4 and 5, the opposite side walls 14 and 15 of the housing carry a pair of bearing members 25 and 26 which are spaced from the periphery of the roll 12 of label strip, FIGS. 1 and 3. A shaft 27 is carried by the bearing members 25 and 26 within the housing 11, the shaft 27 being adapted to have the backing strip 13 wound thereon after the pressure-sensitive adhesive coated labels L are peeled therefrom. A hand wheel 28 is fixed to one end of the shaft 27 for rotating the shaft. For ease in manufacture, the wheel 28 and the shaft 27 preferably are molded as an integral unit. The wheel and shaft unit has an axial opening therethrough which is adapted to fit over the respective bearings 25 and 26 carried by the side walls 14 and 15. Thus it will be seen that the shaft 27 functions as a take-up drum for the used backing strip. For ease in manufacture the bearing 25 preferably is molded as an integral part of the side wall 14 and the bearing 26 is molded as an integral part of the side wall 15. Also molded with the side wall 14 is a pair of parallel projecting members 29, 30 which form an interlocking dispensing maze and support the cantilevered dispensing maze 20, 21 carried by the side wall 15 of the housing. The free ends of the members 20 and 21 are shortened to correspond to the length of members 29 and 30 to provide for clearance of the wheel 28. The side wall 14 has a plurality of pins 31 integrally molded therewith which are adapted to be received in a corresponding plurality of openings 32 in the edges of the end walls and top and bottom of the housing. Thus it will be seen that the wall 14 functions as a removable cover for the housing.

When the parts in the exploded view of FIG. 5 are assembled as shown in FIG. 1, the shaft 27 and wheel 28 are mounted on the bearings 25 and 26. The edge of the wheel 28 partially extends from the housing through an opening 33 in the top of the housing. The wheel 28 is adapted for manual rotation to dispense labels L from the backing strip 13 and the used backing strip is wound on the shaft 27 within the housing where the backing strip is stored as the strip is unwound from the supply roll 12.

To load the supply roll 12 into the dispenser 10, the side wall or cover 14 is removed from the remainder of the housing by pulling the pins 31 out of the recesses 32. The free end of the strip 13 of a new supply roll of labels 12 is secured to the shaft or drum 27 by using one of the labels L to secure the end of the backing strip 13 to the shaft 27. The backing strip 13 is then looped over the dispensing flat or member 21 having the stripping edge thereon so that the backing strip passes from the supply roll 12 out through the opening 22 over the stripping edge 21 and back into the housing through opening 23. The free end of the shaft 27 is then placed over the bearing 25 so that the wheel 28 partially extends through the opening 33 in the top of the housing. To complete the assembly the cover or side wall 14 is replaced on the housing with the bearing 25 extending into the opening **28*a* in the wheel 28 and the pins 31 reassembled with the corresponding openings 32** in the remainder of the housing.

To dispense a label L from the dispenser 10, the wheel 28 is rotated in the direction of the arrow thus causing the backing strip 13 to wrap around the shaft 27. This causes the strip 13 with the labels L thereon to pass out of the housing through the discharge opening 22 and over the stripping edge 21. The labels L are peeled away from the backing strip 13 by sharply reversely bending the backing strip 13 over the edge 21. The backing strip 13 re-enters the housing through the opening 23 so that the backing strip can be wound onto the shaft 27. After the label L is stripped from the backing strip 13 the label L lands on an area of the member 20 which projects beyond the stripping edge 21 where it may be grasped by the user and then applied to the envelope or other object on which it is to be used. For convenience in use, the periphery of wheel 28 preferably is provided with serrations or teeth **28*b* which enable the wheel to be easily turned. In order to prevent the wheel from moving in a reverse direction, a ratchet finger 34 may be provided as shown in FIG. 3 which is adapted to engage the teeth on the wheel 28 and prevent reverse rotation thereof. The ratchet finger 34 is pivotally carried on pivot 35 by the end wall 18. It will be noted in FIG. 3 that the supply roll 12 and the take-up drum or shaft 27 are positioned so that as the supply roll 12 decreases in diameter there is room for the used backup tape 13 on drum 27** to increase in diameter.

From the above description it will be seen that the label dispenser 10 can be readily molded in three parts, namely the housing unit, cover and drum with wheel as illustrated in FIG. 5 of the drawing. While it is not necessary to do so, this does provide for reduced manufacturing costs. The various parts of the dispenser preferably are molded from polystyrene, polypropylene or other suitable plastic materials. By placing the hand wheel within the housing the dispenser is easily packaged for shipping and minimizes damage in shipment. This is a desirable advantage as label dispensers are frequently sold by mail order. While the invention has been described and illustrated in the preferred embodiment in connection with molded plastic parts, it is to be understood that the housing may be made of other materials such as metal or wood. The novel concept of placing the hand wheel within the housing may also be utilized in connection with housings which do not have rigid side walls such for example as cardboard. However, such housings are more subject to crushing during shipment and do not have the advantage of being capable of being molded in integral units as described above.

Figure 6:
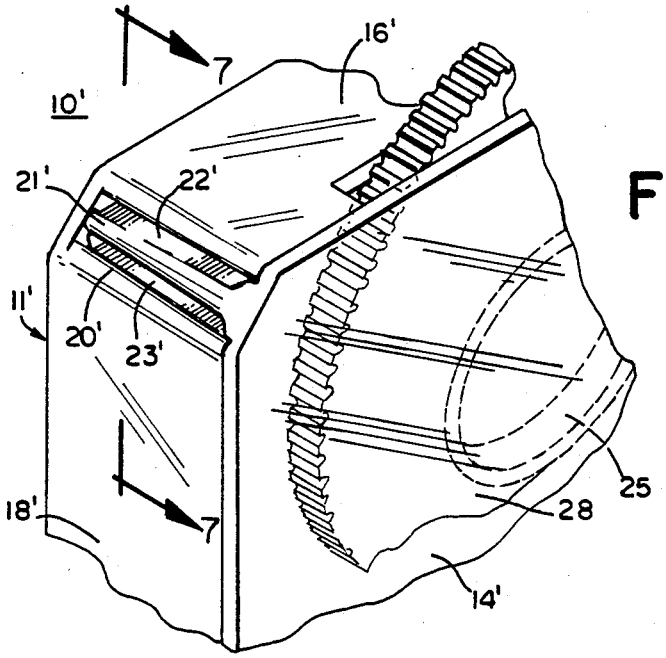
FIG. 6 is a fractional perspective view of a modification of my invention.
Figure 7:
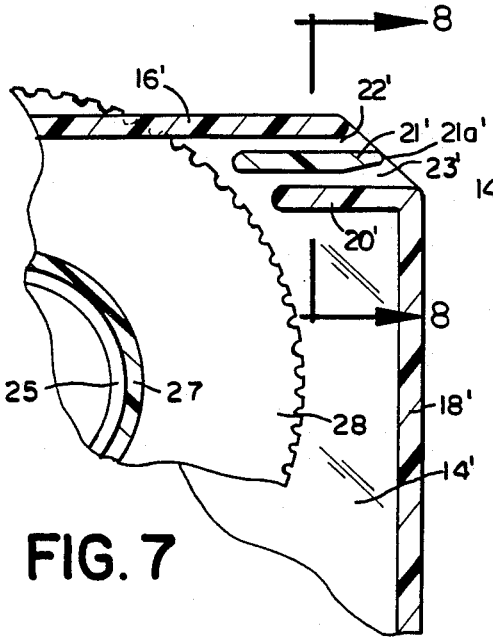
FIG. 7 is a sectional view taken along the lines 7—7 in FIG. 6.
Figure 8:
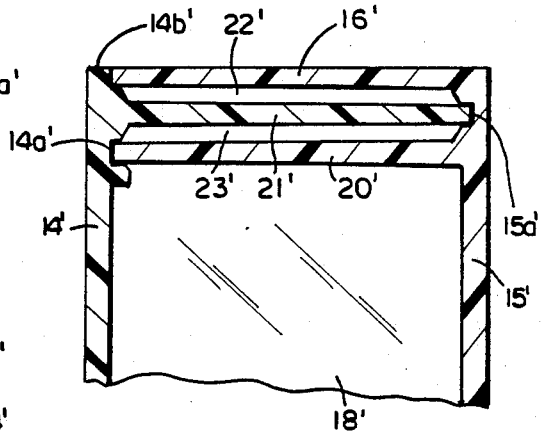
FIG. 8 is a sectional view taken along the lines 8—8 in FIG. 7.

Referring to FIGS. 6–8 there is illustrated a modification of the label dispenser. The label dispenser 10' illustrated in FIGS. 6–8 is similar to the label dispenser 10 illustrated in FIGS. 1–5 with corresponding parts being provided with corresponding reference characters. The essential difference between the label dispenser 10 and the label dispenser 10' is in the manner of supporting the cantilevered dispensing maze 20 and 21. The label dispenser 10', like the label dispenser 10, can be readily molded in three parts, namely the housing unit 11' comprising the side wall 15', the top 16', the end wall 18' and the bottom and the other end wall (not shown), the cover 14' and drum 27 with the wheel 28. As may be seen in FIGS. 6–8 the cantilevered finger 21' is integral with the side wall or cover 14' while the cantilevered finger 20' and the top 16' is integral with the side wall 15' of the housing 11'. The outer end of the finger 21' is supported in an alignment groove or slot 15a' in the wall 15' and the outer end of the finger 20' is supported in the slot or groove 14a' in the wall 14'. As shown in FIG. 8 the top 16' is also supported in the groove 14b' in the wall 14'. Thus it will be seen that the discharge opening 22' is formed between the top 16' and the finger 21' and the reentry opening 23' is formed between the finger 21' and the finger 20'. It will be recognized that similar to the dispenser 10 the label strip supply roll for the dispenser 10' is contained therein. The strip is adapted to be withdrawn from the housing through the discharge opening 22' toward and over the edge 21a' of the finger 21' to dispense the label. The backing strip then re-enters the housing through the re-entry opening 23 where the backing strip is wound on the drum 27.

The label dispenser 10' illustrated in FIGS. 6–8 has advantages both in dispensing and in molding. The label manufacturers have found it commercially desirable to make the pressure sensitive labels quite thin. The thin labels lack rigidity thus causing the label to tend to follow the backing strip in making a large radius turn during the dispensing operation rather than the label continuing in a straight line and be dispensed from the backing strip. For example with a label backing strip thickness of about 0.0025" the label may have a thickness of about 0.0035" making a total thickness of 0.006". To provide proper label dispensing action the dispensing opening 22' should be a uniform air gap of about 0.030", the air gap being provided by the spaced parallel opposing surfaces of the top 16' and the finger 21'. The air gap for the re-entry opening 23' should have a similar dimension and is formed by the spaced parallel opposed surfaces of the finger 21' and the finger 20' By molding the finger 21' integral with the cover 14' and molding the finger 20' integral with the wall 15' of housing 11' the normal one degree of taper used for injection molding will provide the parallel uniform air gap for the label discharge and re-entry openings. This results since the taper for the finger 21' runs in the opposite direction of the taper for the top 16' and the lower finger 20', FIG. 8. By utilizing the small air gap as described above in combination with the small radius on the dispensing edge 21a' of finger 21' the backing strip with the label thereon is prevented from making a larger turn which will not dispense the label prior to its re-entry into the dispenser. The small gap prevents the large radius turn and results in the sharp reverse bending of the strip as it passes over the edge 21a', FIG. 7, thus insuring the proper dispensing operation. By supporting the free ends of the fingers 20' and 21' in the corresponding slots 14a' and 15a' the proper air gap for the openings 22' and 23' is maintained.

The dispenser 10' like the dispenser 10 has been illustrated in the drawings as being molded from a transparent plastic which makes for an attractive unit as well as permitting the user to see the amount of labels remaining in the dispenser without the need for opening the dispenser. It is to be understood that the dispenser 10' would include a ratchet finger to prevent the wheel from moving in reverse direction similar to the ratchet finger 35 disclosed in FIG. 3. It is also to be understood that the other portions of the label dispenser 10' not illustrated in FIGS. 6–8 would be similar to those portions illustrated in FIGS. 1–5. Thus it is believed not necessary to repeat them in FIGS. 6–8.

While the invention has been particularly shown and described with reference to the preferred embodiments thereof, it will be understood by those skilled in the art that various changes in form and detail in applying the concepts of the invention may be made without departing from the spirit or scope of the appended claims.

What is claimed is:

1. A dispenser for dispensing labels from a label strip comprising a backing strip upon which the labels are mounted with a pressure-sensitive adhesive backing on the labels, the labels being adapted to be peeled away from the backing strip by sharply reversely bending the backing strip over an edge, the improvement comprising:

a housing for containing a supply roll of such a label strip, said housing having side walls, a top, a bottom and end walls, said housing being provided with an edge adjacent the junction of one of said end walls and the top thereof, together with an opening adjacent said junction, the strip being adapted to be withdrawn from said housing through said opening toward and over said edge to dispense a label;

a second opening in said housing adjacent to and spaced from said first named opening to permit the backing strip to reenter the housing after dispensing a label, said openings and said edge comprising a dispensing maze for the backing strip, said dispensing maze including two vertically spaced cantilevered fingers each supported by one of said side walls, said cantilevered fingers being separated at their outer ends by an interlocking structure supported by the opposite one of said side walls, bearing means carried by at least one of the side walls within said housing and spaced from the periphery of the roll of label strip;

a shaft carried by said bearing means within said housing, said shaft being adapted to have the backing strip wound thereon after the pressure-sensitive adhesive backed labels are peeled therefrom; and a hand wheel fixed to one end of said shaft for rotating said shaft, said hand wheel being positioned within said housing between said side walls and partially extending through an opening in said housing for manual rotation to dispense labels from the backing strip and for storing the backing strip on said shaft within said housing as the strip is unwound from the roll.

2. A dispenser for dispensing labels according to claim 1 wherein one of said cantilevered fingers, one of the said side walls, said top, said bottom and said end walls are molded from plastic as an integral housing unit.

3. A dispenser for dispensing labels according to claim 2 wherein tho other one of said side walls provides a cover for said housing and is detachably carried by said housing for loading and unloading the dispenser with a supply roll of labels, said cover and the other one of said cantilevered fingers being molded from plastic as an integral unit.

4. A dispenser for dispensing labels according to claim 1 wherein said shaft and said hand wheel are molded from plastic as an integral unit.

5. A dispenser for dispensing labels according to claim 1 wherein said shaft with said hand wheel fixed to one end thereof have an axial opening extending therethrough and said bearing means extends into said axial opening for supporting said shaft and said hand wheel.

6. A dispenser for dispensing labels according to claim 1 wherein one of said cantilevered fingers is supported from one of said side walls and the other of said cantilevered fingers is supported from the other of said side walls and both of said cantilevered fingers are parallel to each other.

7. A dispenser for dispensing labels according to claim 1 wherein both of said vertically spaced cantilevered fingers are supported by one of said side walls.

8. A dispenser for dispensing labels according to claim 7 wherein said cantilevered fingers are supported at their outer ends by an interlocking dispensing maze supported by the other of said side walls.

9. A dispenser according to claim 1 wherein said housing is molded from transparent plastic.

10. A dispenser according to claim 1 wherein said hand wheel is provided with a serrated periphery for cooperation with a ratchet finger carried by said housing to prevent reverse rotation of said hand wheel.

11. A dispenser for dispensing labels from a label strip comprising a backing strip upon which the labels are mounted with a pressure-sensitive adhesive backing on the labels, the labels being adapted to be peeled away from the backing strip by sharply reversely bending the backing strip over an edge, the improvement comprising:

a housing for containing a supply roll of such a label strip, said housing having a pair of side walls spaced apart by a pair of end walls, said housing being provided with an edge member extending between said side walls adjacent the top of one of said end walls together with an opening adjacent one side of said edge member, the strip being adapted to be withdrawn from said housing through said opening toward and over said edge member to dispense a label;

a second opening in said housing adjacent to the other side of said edge member and spaced from said first named opening to permit the backing strip to reenter the housing after dispensing a label, said openings and said edge member comprising a dispensing maze for the backing strip, said dispensing maze including a pair of vertically spaced cantilevered fingers supported on one of said side walls, said cantilevered fingers being supported at their outer ends by an interlocking dispensing maze including a pair of parallel projecting members supported by the other of said side walls;

bearing means caried by one of said side walls within said housing and spaced from the periphery of the roll of label strip;

a shaft rotatably carried by said bearing means within said housing, said shaft being adapted to have the backing strip wound thereon after the pressure-sensitive adhesive backed labels are peeled therefrom; and a hand wheel fixed to one end of said shaft for rotating said shaft, said hand wheel being positioned within said housing between said pair of side walls and partially extending through an opening in said housing for manual rotation to dispense labels from the backing strip and for storing the backing strip on said shaft within said housing as the strip is unwound from the roll.

12. A dispenser for dispensing labels according to claim 11 wherein said bearing means comprises a pair of bearing members carried by the pair of side walls within said housing and spaced from the periphery of the roll of label strip.

13. A dispenser for dispensing labels according to claim 11 wherein one of the said side walls and said pair of end walls are molded from plastic as an integral housing unit.

14. A dispenser for dispensing labels according to claim 11 wherein said shaft and said hand wheel are molded from plastic as an integral unit.

15. A dispenser for dispensing labels according to claim 11 wherein said shaft with said hand wheel fixed to one end thereof have an axial opening extending therethrough and said bearing means extend into said axial opening for supporting said shaft and said hand wheel.

16. A dispenser for dispensing labels according to claim 11 wherein one of said side walls is detachably carried by said housing for loading and unloading the dispenser with a supply roll of labels.

17. A dispenser for dispensing labels according to claim 11 wherein said housing is molded from transparent plastic.

* * * * *